US006702871B1

(12) United States Patent
Fugleberg et al.

(10) Patent No.: US 6,702,871 B1
(45) Date of Patent: Mar. 9, 2004

(54) METHOD FOR THE REDUCTION OF NICKEL

(75) Inventors: Sigmund Fugleberg, Turku (FI); Matti Hämäläinen, Pori (FI); Kari Knuutila, Pori (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/129,592

(22) PCT Filed: Oct. 27, 2000

(86) PCT No.: PCT/FI00/00934

§ 371 (c)(1),
(2), (4) Date: May 7, 2002

(87) PCT Pub. No.: WO01/34859

PCT Pub. Date: May 17, 2001

(30) Foreign Application Priority Data

Nov. 9, 1999 (FI) ..... 19992407

(51) Int. Cl.[7] ..... B22F 9/26
(52) U.S. Cl. ..... 75/374
(58) Field of Search ..... 75/371, 374

(56) References Cited

U.S. PATENT DOCUMENTS 3,833,351 A 9/1974 Neskora et al.
3,989,509 A 11/1976 Chou et al.
4,089,676 A * 5/1978 Grundy ..... 75/374
4,761,177 A * 8/1988 Chou et al. ..... 75/374
6,120,576 A * 9/2000 Toshima et al. ..... 75/374

FOREIGN PATENT DOCUMENTS

GB 1 231 572 5/1971
JP 5 604 7526 4/1981

OTHER PUBLICATIONS

W. Kunda et al. Proceed Int'l. Powder Metal Conference., New York 1965, (ed. H.H. Hausner, Pergamon 1966) pp 15–49. 4–6.

R. Derry, R.G. Whittemore; Int'l Symposium on hydrometallurgy, 1973, Chicago pp. 42–54.

* cited by examiner

*Primary Examiner*—George Wyszomierski
(74) *Attorney, Agent, or Firm*—Morgan & Finnegan LLP

(57) ABSTRACT

The invention relates to a method for the precipitation of nickel from its aqueous solution as a metal powder using hydrogen. The aqueous solution containing nickel compounds is neutralised first with an earth alkali or alkali compound so the nickel precipitates as nickel hydroxide or as an alkaline salt, after which reduction is performed in the presence of a catalyst in ion form in atmospheric or close to atmospheric conditions preferably as a continuous process.

13 Claims, No Drawings

METHOD FOR THE REDUCTION OF NICKEL

This invention relates to a method for the precipitation of nickel from its aqueous solution as a metal powder using hydrogen. The aqueous solution containing nickel compounds is neutralised first with an earth alkali or alkali compound so the nickel precipitates as nickel hydroxide or as an alkaline salt, after which reduction is performed continuously in the presence of a catalyst in ion form in atmospheric or close to atmospheric conditions.

According to the prior art, the hydrometallurgical production of nickel powder generally takes place with hydrogen gas. The most commonly used method is reduction from an ammoniacal sulphate solution, into which nickel has been dissolved as an ammine complex. These kinds of methods have been described by Sherritt Gordon Mines and Amax. In these methods the neutralising agent, ammonia, is added to the nickel sulphate solution, after which hydrogen is conducted into the solution and reduction takes place. This is described in the following reaction equation:

$$NiSO_4 + 2\,NH_3 \xrightarrow{\text{neutralisation}} Ni(NH_3)_2SO_4 + H_2 \xrightarrow{\text{reduction}} Ni^\circ + (NH_4)_2SO_4 \quad (1)$$

The above reduction is a heterogeneous reaction, which requires a catalyst to begin. Many substances are used as catalyst, but iron sulphate $FeSO_4$ is widely used, which precipitates as iron hydroxide $Fe(OH)_2$ when it is added to an alkaline solution. It is assumed that iron hydroxide forms active nuclei on top of which the nickel begins to reduce. When reduction progresses further, the nickel powder itself begins to act as a reduction-promoting catalyst and the reaction proceeds autocatalytically.

Ammonia is a good neutralising agent because it and the ammonium sulphate it generates are water-soluble. Ammonium sulphate can also be recovered by evaporation and crystallisation and used as fertiliser or similar raw material. However this is not always profitable. For these situations other neutralising agents, cheaper than ammonia, have been sought and mention of these can be found in the literature. One particularly interesting alternative is of course lime, which is one of the cheapest neutralising agents and offers the possibility of removing the sulphate from the solution as gypsum. Magnesium oxide also has its benefits.

A method is described in GB patent 1,231,572 in which a neutralising agent other than ammonia is used. The method has never been adapted for industrial production and the reason is no doubt the special technology demanded by the severe conditions of the method. The following reactions occur in the said method:

$$NiSO_4 + Ca(OH)_2 \xrightarrow{\text{neutralisation}} Ni(OH)_2\downarrow + CaSO_4\downarrow + H_2 \xrightarrow{\text{reduction}} Ni^\circ + CaSO_4 + 2H_2O \quad (2)$$

In the conference publication W. Kunda et al; Proceed. Int. Powder Met. Conf., New York, 1965, (ed. H. H. Hausner, Pergamon, 1966) it is presented on pp. 15–49 that the reduction of nickel hydroxide did not occur at a temperature of 175° C. and hydrogen pressure of 350 psi (≈25 bar), not even in the presence of a catalyst. The symposium publication R. Derry, R. G. Whittemore; Int. Symp. on Hydrometallurgy 1973, Chicago, mentions on page 42 that seed crystals are not needed in these kinds of systems, and on page 54 that only a slight reduction of the slurry was possible at a temperature of 170° C. even though less than the stoichiometric amount of lime was used, but at a temperature of 200° C. reduction proceeded quickly as long as there was not an excess of lime. In these tests the partial pressure of hydrogen was 15–40 bar.

In the method now developed the aqueous solutions of nickel are first treated in the known way so that a nickel compound, such as for instance nickel sulphate in aqueous solution, is neutralised with an earth alkali or alkali compound in order to precipitate the nickel. In this way nickel precipitate is formed, which is either nickel hydroxide or an alkaline salt of nickel, and according to the invention it is possible to reduce the nickel from a slurry of said precipitate in much easier conditions than those described above and even as a continuous process. It is stated in the publications mentioned above that a hydroxide slurry is autocatalysing, even though it demands high pressure and temperature. We have, however, now found that using an external catalyst enables reduction to take place in considerably easier conditions than those described above, i.e. in atmospheric or close to atmospheric conditions. Surprisingly it has also been found that the key factor is not only the catalyst itself, but how the catalyst is fed into the process. An essential feature of the invention is that the catalyst is at least partially in ion form in the solution in the reduction stage of the nickel precipitate slurry and that preferably the catalyst is introduced into the nickel precipitate at the same time as the reducing agent, at least in the early stages of reduction. The essential features of the invention will be made apparent in the attached patent claims.

It has now been found that, for instance, divalent iron in the solution (in ion form) is a strong catalyst for the reduction of nickel hydroxide slurry to such an extent that reduction proceeds quickly at temperatures of even less than 100° C. and at atmospheric pressure. Tests carried out have proved that reduction begins at as low as 60° C. and is significant at 80° C. at an $H_2$- pressure of 0.5 bar. Reduction is carried out preferably at temperatures between 80–130° C. and hydrogen partial pressure of 0.5–6 bar. Naturally the method also works at both higher temperatures and higher partial pressures of hydrogen, but in that way the essential benefit of the invention is lost—functioning in atmospheric conditions or at slight overpressure.

In addition to divalent iron, at least partially dissolved divalent chrome, $Cr^{2+}$, can also be used as catalyst. The method now developed is also easy to adapt for a continuous process, which would lower both investment and operating costs considerably.

In the method according to the present invention, a little less than the stoichiometric amount, 70–98%, preferably 95–98%, of a neutralising agent such as CaO, $Ca(OH)_2$, NaOH, MgO or other suitable alkali or earth alkali compound is added to a nickel sulphate solution in order to precipitate nickel as nickel hydroxide or an alkaline nickel salt. Ammonia can also be used as catalyst, if so desired. As stated above, the advantage of lime is its reasonable price and possibility to remove sulphate as gypsum.

A small amount of $FeSO_4$ in aqueous solution is added to the nickel hydroxide slurry as catalyst so that at least some of the iron is ion form in the solution. Hydrogen acting as reduction gas is added immediately to the solution so that reduction can begin without delay. Hydrogen gas is added until all the nickel has been reduced. However, the invention is not restricted to this procedure, as other methods can be used so long as the procedure ensures the presence of iron ions (or chrome ions) acting as catalyst in the solution when the hydrogen gas is introduced. The method operates according to reaction (2) presented above.

The importance of a catalyst in this method and the way its existence is controlled, namely as divalent $Fe^{2+}$ ions in solution, is described further in the following examples.

EXAMPLE 1

34 g/l $Ca(OH)_2$ was added to a nickel sulphate solution containing 30 g/l Ni. The slurry was immediately placed in an autoclave and heated to 120° C. Hydrogen was fed under the mixers and the partial pressure of hydrogen of 5 bar was maintained for 2 hours. After this the precipitate was inspected and found to be a green Ni hydroxide, thus reduction had not taken place.

EXAMPLE 2

The procedures in the previous example were repeated, with the exception that before the slurry was placed in the autoclave, a solution with 0.5 g/l $FeSO_4$ was added to it. The first sample was taken 10 min after the start of reduction. The sample was completely black reduced nickel. The next sample was taken after 20 min and was grey. At this stage the pH of the slurry had dropped to a value of 4.3 from the original 7.6. This showed that there was no longer any Ni hydroxide and that reduction had reached completion.

EXAMPLE 3

The procedure in example 2 was repeated, but in this case the slurry and the Fe catalyst in it were left to stand for 2 hours. The first sample was taken 2 hours after the start of reduction (when the hydrogen gas started to be fed into the slurry). The sample showed that reduction had just begun, but the metallic nickel could not be separated from the sample because the latter was completely non-magnetic. This indicates that at least in certain conditions the presence of iron alone is not sufficient to achieve reduction.

EXAMPLE 4

A series of tests were made to determine the role of iron. In all the tests the nickel solution contained 58.7 g/l nickel i.e. 1 mole/l. The amount of $Ca(OH)_2$ and iron added varied as did the manner of addition and the time between the addition of iron and the start of reduction (hydrogen feed). The results are presented in the following table, where waiting time means the time which elapsed between the addition of iron and the start of the hydrogen feed and incubation time means the time elapsed between the start of the hydrogen feed and when the reactions began in the container.

TABLE 1

| Test | $Ca(OH)_2$ | Added $Fe^{2+}$ | Waiting Time | Incub. Time | Red. Time | Amount of $Fe^{2+}$ during reduction, mg/l Time min | | | | | |
|---|---|---|---|---|---|---|---|---|---|---|---|
| No | mole/l | g/l | min | min | min | 0 | 10 | 20 | 30 | 60 | 120 |
| 1 | 0.9 | 1 | 0 | 0 | 20 | 100 | 160 | 400 | 500 | | |
| 2 | 0.9 | 1 | 30 | 20 | 40 | <5 | <5 | 15 | 130 | 350 | 450 |
| 3 | 0.9 | 1 | 60 | >120 | no red. | <5 | <5 | <5 | <5 | <5 | <5 |
| 4 | 0.8 | 1 | 30 | <10 | 30 | 5 | 25 | 60 | 150 | 300 | 550 |
| 5 | 0.7 | 1 | 30 | 0 | 20 | 140 | 210 | 450 | | | |

The only significant factor, which seemed to have a clear effect on reduction in these tests, was the amount of iron ions in the solution. If the amount of divalent iron was less than 5 mg/l, reduction did not take place, and this led to long incubation times, as seen in tests 2 and 3. When the value of 5 mg/l was exceeded, reduction began nor was the reduction rate thereafter so strongly dependent on the concentration of iron ions. Tests 1–3 showed also that before reduction the iron may precipitate when the slurry is standing, and may possibly also co-precipitate as the Ni precipitate crystallises. Therefore it is important to begin reduction as quickly as possible after the catalyst has been added.

The tests performed also indicate that regarding the reduction-catalysing effect of iron it is not a question of the action of solid iron hydroxide as a seed crystal for the formation of nickel particles, but rather that the ferro-ions in the solution play the key role in reduction. It was also indicated that the smaller the amount of neutralising agent that was added, the easier it was to keep the iron in solution and the shorter the treatment time. This shows that the process is less sensitive if it is run continuously. Then only a part of the neutralising agent is added to the first reactor, where the catalyst is also added and thus the risk of the catalyst precipitating would be smaller. The rest of the neutralising agent could in this case be added to the next reactors in the series, where keeping the catalyst in solution would be easier.

EXAMPLE 5

A fifth series of consecutive tests was carried out. NaOH was used as neutralising agent in a mole ratio of 0.9 per mole of nickel. In each test the nickel formed was separated and taken for use in the next test. The iron catalyst was added only in the first test. The progress of the reduction was monitored by adding acid to a slurry sample until the pH had stabilised at a value of 2.0 (residual Ni hydroxide dissolves at this pH) and the amount of nickel in the solution thus formed was determined. The amount of reduced nickel could be calculated from this result and the original amount of nickel put in the test. The test results are shown in Table 2.

TABLE 2

| Test | Ni at start | Added $Fe^{2+}$ | NaOH | Amount of unreduced Ni, g/l Time min | | | | |
|---|---|---|---|---|---|---|---|---|
| No | g/l | g/l | g/l | 10 | 20 | 30 | 60 | 120 |
| 1 | 30 | 1 | 41 | 18 | 7 | 2.5 | 2.3 | 2.5 |
| 2 | 30 | 0 | 41 | 17 | 8 | 3 | 2.5 | 2.5 |

TABLE 2-continued

| Test | Ni at start | Added $Fe^{2+}$ | NaOH | Amount of unreduced Ni, g/l Time min | | | | |
|---|---|---|---|---|---|---|---|---|
| No | g/l | g/l | g/l | 10 | 20 | 30 | 60 | 120 |
| 3 | 30 | 0 | 41 | 21 | 12 | 5 | 2.5 | 2.5 |
| 4 | 30 | 0 | 41 | 25 | 16 | 8 | 5 | 3.5 |
| 5 | 30 | 0 | 41 | 27 | 22 | 15 | 12 | 10 |

The series of tests above showed that the addition of iron to each batch is not necessary, but that the nickel powder formed acts as a crystal nucleus itself after a certain precipitation time.

periods 1, 2, 3 and 4, the feed of $Ca(OH)_2$ was about 75% of the theoretical, but in period 5 it was 95%. The results show that reduction proceeded then also at the same rate as with a lower degree of neutralisation, in other words the degree of reduction was largely the same at both ratios of lime feed. The results also show that most of the reduction occurs in the first segment, i.e. at a retention time of about 10 minutes.

The results presented in the examples show that the invention can be made use of in very different ways, and it has not been possible to present here all the accomplishments belonging to the scope of this invention.

TABLE 3

| Test | Temperature | Partial pressure of $H_2$ | Ni feed | Total delay time | Distribution of Ni in separate sections, g/l, % 1 | | | | 3 | | | | 6 | | | |
|---|---|---|---|---|---|---|---|---|---|---|---|---|---|---|---|---|
| | | | | | $Ni^{++}$ | $Ni(OH)_2$ | Ni-pow. | | $Ni^{++}$ | $Ni(OH)_2$ | Ni-pow. | | $Ni^{++}$ | $Ni(OH)_2$ | Ni-pow. | |
| No. | ° C. | bar | g/l | min | g/l | g/l | g/l | % | g/l | g/l | g/l | % | g/l | g/l | g/l | % |
| 1 | 120 | 2.5 | 45 | 60 | 8.4 | 1 | 36 | 79 | 8.8 | 1 | 35 | 78 | 8.9 | 0.4 | 36 | 79.4 |
| 2 | 100 | 5 | 30 | 60 | 9.7 | 1 | 19 | 64 | 9.1 | 0.4 | 20 | 68 | 9.8 | 0.3 | 20 | 66.4 |
| 3 | 100 | 2.5 | 45 | 60 | | | | | 8.9 | 1 | 35 | 78 | 8.7 | 0.3 | 36 | 80.1 |
| 4 | 85 | 1 | 45 | 120 | 7.4 | 3.5 | 34 | 76 | 7.3 | 3 | 35 | 77 | 9 | 0.5 | 35 | 78.8 |
| 5 | 85 | 1 | 27 | 65 | 0.7 | 2.1 | 24 | 90 | 0.8 | 1.7 | 25 | 91 | 0.6 | 0.8 | 26 | 94.7 |

EXAMPLE 6

Continuous reduction was carried out in an autoclave of 50 l with 6 segments. A slurry of lime milk and $NiSO_4$ solution were fed into two mixing reactors of 2 l connected into series in order to precipitate $Ni(OH)_2$, after which the slurry flowed into a feed tank, from which it was fed into an autoclave. There was a 5–15 min retention time in the feed tank, depending on the running speed.

The progress of reduction was monitored by titrating slurry samples at a pH of 2 and the amount of dissolved nickel was determined. The amount of reduced nickel was obtained as the difference between the nickel fed into the reactor and the reduced nickel. It was possible to follow the effect of the retention time by taking samples from different segments. Iron sulphate $FeSO_4$ was used as catalyst, which was added first to the first mixing reactor, but then the amount of divalent $Fe^{2+}$ in the autoclave when reduction began was below the level of 5 mg/l and reduction did not occur. When the $FeSO_4$ solution was fed directly into the first segment of the autoclave, reduction began to take place immediately. The temperature was kept between 85–120° C. and the partial pressure of hydrogen in the region of 1–5 bar. See results in Table 3.

The amount of divalent iron varied in the different test periods between 30–500 mg/l. When there was an interruption and the iron feed stopped, reduction also ceased within a short time. The only clear effect of the amount of iron to become apparent on examination of the results was that there should preferably be at least 5 mg/l of iron. The amount of $Fe^{2+}$ fed was about 1% of the amount of nickel except in period 5, when it was 0.5%. Most of the time,

What is claimed is:

1. A method for the precipitation of nickel from an aqueous solution of nickel sulphate as a metal powder, comprising first neutralizing said aqueous solution of nickel compound with an earth alkali or alkali compound in order to precipitate the nickel precipitate as nickel hydroxide or as an alkaline salt, and then carrying out reduction of the nickel precipitate slurry in the presence of hydrogen as reducing agent at a hydrogen partial pressure of 0.5–6 bar, and at a temperature between 80–130° C. in the presence of a catalyst in ion form in aqueous solution and feeding the catalyst and the hydrogen reducing agent simultaneously into the nickel precipitate at least during the early stages of reduction.

2. A method according to claim 1, further comprising carrying out the nickel precipitate reduction continuously.

3. A method according to claim 1, further comprising carrying out the nickel precipitate reduction with divalent iron as the catalyst.

4. A method according to claim 3, wherein the amount of divalent iron in the solution is at least 5 mg/l.

5. A method according to claim 3, wherein an aqueous solution of ferrous sulphate $FeSO_4$ is used as catalyst.

6. A method according to claim 1, further comprising carrying out the nickel precipitate reduction with divalent chrome as the catalyst.

7. A method according to claim 1, further comprising using 70–98% of the stoiciometric amount of neutralizing agent for the aqueous solution of nickel sulphate.

8. A method according to claim 1, further comprising using a calcium compound as the neutralising agent for the aqueous solution of nickel sulphate.

9. A method according to claim 8, wherein the calcium compound is calcium hydroxide.

10. A method according to claim 8, wherein the calcium compound is calcium oxide.

11. A method according to claim 1, further comprising using a sodium compound as neutralising agent for the aqueous solution of nickel sulphate.

12. A method according to claim 11, wherein the sodium compound is sodium hydroxide.

13. A method according to claim 1, further comprising using magnesium hydroxide as neutralising agent.

* * * * *